United States Patent [19]

Carreno

[11] Patent Number: 5,054,996

[45] Date of Patent: Oct. 8, 1991

[54] THERMAL LINEAR ACTUATOR FOR ROTOR AIR FLOW CONTROL IN A GAS TURBINE

[75] Inventor: Diether Carreno, Schenectady, N.Y.

[73] Assignee: General Electric Company, Schenectady, N.Y.

[21] Appl. No.: 558,450

[22] Filed: Jul. 27, 1990

[51] Int. Cl.[5] ..... F01D 5/14

[52] U.S. Cl. ..... 415/115; 415/48; 415/116; 415/146; 60/39.75

[58] Field of Search ..... 415/47, 48, 115, 116, 415/134, 12, 146; 416/96 R, 97 R; 60/39.75

[56] References Cited

U.S. PATENT DOCUMENTS

| | | | |
|---|---|---|---|
| 1,557,197 | 10/1925 | Dickey . | |
| 1,823,624 | 9/1931 | Nagler . | |
| 2,811,833 | 11/1957 | Broffitt . | |
| 3,663,118 | 5/1972 | Johnson . | |
| 3,834,831 | 9/1974 | Mitchell . | |
| 3,966,352 | 6/1976 | White et al. . | |
| 3,966,354 | 6/1976 | Patterson . | |
| 3,975,901 | 8/1976 | Hallinger et al. . | |
| 4,109,864 | 8/1978 | Clayton . | |
| 4,213,738 | 7/1980 | Williams . | |
| 4,217,755 | 8/1980 | Williams . | |
| 4,337,016 | 6/1982 | Chaplin | 415/116 |
| 4,487,016 | 12/1984 | Schwarz et al. . | |
| 4,541,775 | 9/1985 | Hovan . | |
| 4,708,588 | 11/1987 | Schwarz et al. . | |
| 4,719,747 | 1/1988 | Willkop et al. . | |
| 4,730,982 | 3/1988 | Kervistin . | |
| 4,741,153 | 5/1988 | Hallinger et al. . | |
| 4,795,307 | 1/1989 | Liebl . | |
| 4,805,398 | 2/1989 | Jourdain et al. . | |
| 4,815,272 | 3/1989 | Laurello . | |
| 4,841,726 | 6/1989 | Burkhardt . | |
| 4,893,984 | 1/1990 | Davison et al. . | |

FOREIGN PATENT DOCUMENTS

| | | | |
|---|---|---|---|
| 0077127 | 5/1983 | Japan | 416/97 R |

*Primary Examiner*—Edward K. Look
*Assistant Examiner*—Christopher M. Verdier
*Attorney, Agent, or Firm*—Nixon & Vanderhye

[57] ABSTRACT

A gas turbine rotor assembly includes axially spaced rotor discs carried on a shaft, together with first and second generally cylindrical actuators mounted at each of their opposite ends to the shaft and extending toward one another to overlap at their distal ends. The actuators lie within the interior surface of the rotor discs and have openings in their overlapped portions. Upon a transient condition, the forward actuator thermally expands in an axial direction to register at least in part its openings with the openings of the second actuator to provide air flow through the partially aligned openings to opposite sides of an aft rotor disc. The second actuator thermally expands in a forward axial direction to increase the registration of the openings and, hence, the flow-through area, affording increased air flow. When approaching steady state operation, the rotor assembly expands axially to displace the openings of the second actuator into misalignment with the openings of the first actuator to prevent the flow of air through the openings, whereby cooling losses during steady state operation are avoided.

21 Claims, 5 Drawing Sheets

THERMAL LINEAR ACTUATOR FOR ROTOR AIR FLOW CONTROL IN A GAS TURBINE

BACKGROUND AND SUMMARY OF THE INVENTION

The present invention relates to apparatus and methods for controlling the flow of air through a gas turbine rotor to provide substantially uniform heating and cooling of the rotor discs during transient operation and without cooling air losses during steady state rotor operation.

In modern gas turbines, requirements for high efficiency and output have resulted in significant increases in operating temperatures. This, in turn, has led to the design and construction of composite rotor structures using different materials. It has also led to the development of numerous and complicated internal flow circuits for delivering cooling air to the various portions of the gas turbine, including those exposed to the hot gas, to accommodate operation at increased temperatures.

A major problem in high-efficiency, high-temperature gas turbine operation has been non-uniform heating and cooling of the rotor discs. For example, during transient operating conditions, i.e., start-up and other changes in speed between start-up and the turbine's rated speed, there is a significant temperature differential between the outer peripheral parts of the turbine discs, including the buckets, and the inner portion of the rotor disc. This essentially radial, thermal gradient can cause high thermal stress. Concomitantly during such transient operations, particularly start-up, non-uniformity of heating and cooling in an axial direction also exists, e.g., when the rotor components are heated or cooled only from one side. That is, a thermal gradient exists between opposite sides of the rotor disc in the axial direction. Cooling circuits in rotors frequently provide an air path to the buckets passing over only one side, e.g., the forward side, of the disc but not along its opposite side, e.g., the aft side. Consequently, distortion, for example, dishing, of the disc may occur due to this axial thermal gradient This can lead to changes in the rotor's structural inertia properties, i.e., rotor stability or structural rigidity, with resultant high transient rotor vibration, possible unbalancing and structural failure.

Additional cooling circuits are therefore needed to compensate for the axial thermal gradient during transient conditions and provide substantially uniform heating of the discs. However, additional cooling circuits, when provided consistently and continuously throughout the entire operating range of the turbine, represent significant losses to the efficiency of the turbine. That is, additional cooling circuits are not needed during steady state operation and, if provided, for the needed cooling during transient operations, cause loss of engine efficiency. Consequently, there has developed a need for an air flow control system which minimizes rotor distortion and thermal instability due to non-uniform internal air delivery systems during transient operations and eliminates cooling air losses resulting from those additional cooling circuits during steady state operations. It will be appreciated by those skilled in this art that reference herein to cooling air refers to the compressor discharge air which is quite hot, on the order of 600° F., but which is cool relative to the temperature of the buckets during transient and steady state operations.

In accordance with the present invention, there is provided a linear central actuator for controlling the flow of air through the rotor in a manner to afford substantially uniform heating and cooling of the rotor discs, thereby avoiding thermal instability, stresses and distortion of the discs, while simultaneously avoiding cooling air losses in the system at steady state operation. Thus, the present invention provides such air flow control in a manner which introduces the cooling air to the rotor discs to afford uniformity of heating only during the times necessary to do so, i.e., transient operations, including start-up, whereas during steady state operation, the additional cooling circuit is automatically shut down to avoid cooling air losses. To accomplish the foregoing, there is provided, in accordance with the present invention, a linear actuator for controlling flow of air, particular compressor extraction air, to the rotor discs, including a pair of generally cylindrical actuators having opposite ends secured respectively to flanges at the opposite ends of a rotor shaft mounting a plurality of rotor discs and spacers. The actuators are disposed concentrically about the rotor axis. The distal or interior ends of the cylindrical actuators overlap and lie concentric one with the other. Each actuator is provided with a plurality of openings, preferably both circumferentially and axially spaced one from the other, for passing air from the compressor to opposite sides of one or more discs, preferably the aft rotor disc or discs to effect uniform heating or cooling thereof depending upon the application. More particularly, the actuators are each responsive to temperature changes to thermally expand in the axial direction. The alignment or misalignment of the openings within the actuators is thereby controlled by the thermal expansion of one or both of the actuators in the axial direction. Thus, when the openings in the overlapped portions of the actuators are misaligned, air cannot flow through the openings. When the openings are partially or fully aligned, air may flow therethrough to the opposite sides of the rotor disc or discs. That is, the degree or extent of registration of the openings in the overlapped portions of the respective actuators is determined by the thermal expansion of the actuators. Thus automatic control of the flow of air through the openings and hence, for example, heating the interior portions of the rotor disc is provided.

At start-up, i.e., when the rotor is cold, the openings through the actuators are initially misaligned. Upon start-up, compressor extraction air is ducted internally through cooling passages to supply air to the first and second-stage buckets along their rear and front sides, respectively. These cooling air passages extend past the root of the first-stage disc and consequently provides flow of air over the outside of the first actuator and through its non-overlapped openings into the interior thereof. As the compressor extraction air heats the initially cold first actuator, it thermally expands axially to displace its openings in a rearward axial direction. Depending on factors such as the time constant and coefficient of thermal expansion, the openings of the thermally expanding first actuator begin to overlap the openings in the second actuator at one or more axial locations. This, in turn, permits compressor extraction air from within the overlapped actuators to flow through the registering openings and radially outwardly into chambers on the opposite sides of the aft rotor disc or discs. As air begins to flow through the aligned openings, that air, in turn, heats the second actuator causing it to thermally expand in an axially opposite direction with respect to the direction of expansion of the first actuator, i.e., an upstream or forward direction. This additional expansion of the second actuator increases the aggregate area of the actuators in registry one with the other, hence increasing the air flow entering the chambers on opposite sides of the aft rotor disc or discs and affording uniform heating thereof.

The materials and geometry of the actuators are chosen such that maximum registration of the openings through the actuators is obtained shortly before the turbine obtains a steady state temperature. As the rotor temperature increases to its steady state, the rotor structure continuously heats up. This results in expansion of the rotor which, in turn, displaces the second actuator in an axially rearward direction. This displacement moves the openings of the second actuator in a direction decreasing the aggregate area of the registering openings and hence decreasing the flow of air through the openings. At a predetermined time after start-up or other transient operations, and upon obtaining steady state operations, the rotor displacement is such that the openings are totally misaligned whereby air flow through the openings is completely choked off. That is, when the rotor has obtained its steady state temperature, the additional air circuit affording uniform heating of the aft rotor on its opposite sides is closed off, hence avoiding cooling air losses.

It will be appreciated that the response of the actuators and, hence, the movement of the openings into aligned, partially aligned or wholly misaligned conditions is dependent upon a number of factors, including the diameters of the actuators, the size, number and shape of the openings in both actuators, the choice of actuator materials, i.e., their coefficients of expansion and conductivity, the structural material forming the rotor discs, the time constants of the actuators and rotor discs, the actuator lengths and the cooling air flow and pressures.

Significant advantages reside in the foregoing-described apparatus and method of operation. For example, major components of the gas turbine rotor assembly can be heated quickly and uniformly, thereby reducing stresses, weight and material costs. A thermally stable rotor structure is provided, with no loss in rotor inertia (no thermally induced vibration). There are no losses of cooling air at steady state operation because cooling air is used to afford uniformity of heating in the rotor discs only during transient operations, including start-up. The system is self-regulating by a simple linear motion in an axial direction. For some rotor materials, preheating the bores of the discs early in the transient condition enables providing discs formed smaller in size than without preheating, a desirable feature from rotor life, cost and producibility standpoints. Design flexibility is also afforded by providing a capability to adapt the components to a combination of flow areas. Additionally, the parts are self-contained in a low "g" environment, i.e., a low stress environment adjacent the rotor axis. The actuators are accessible from the rear of the gas turbine for service and do not require the turbine to be opened for service. The actuators can be readily modified to adjust flow rates and shift time response curves when operating conditions change. Finally, transient bore heating of turbine discs is accomplished without compromising bucket supply pressures. Also, as a further embodiment hereof, the actuators may be modified to control bucket cooling flows during transient or steady state operations.

In a preferred embodiment according to the present invention, there is provided a gas turbine rotor assembly, comprising a rotatable shaft, a plurality of turbine rotors each including a disc mounted on the shaft and turbine buckets on the discs along their outer rims. A pair of cylindrical actuators has opposite ends thereof secured respectively to the shaft and adjoining ends free and overlapping concentrically one within the other radially inwardly of the discs. At least one of the actuators is responsive to a change in temperature to expand in one axial direction relative to the other of the actuators, the actuators having at least one opening each therethrough and in the overlapping portions. Means are provided for supplying compressor extraction air within the cylindrical actuators for communication through the openings, one actuator being movable in one axial direction in response to a change in temperature during transient turbine operation to register at least in part its opening with the opening of the other actuator to enable air to flow from within the actuators through the registered openings to opposite sides of one of the rotor discs.

In a further preferred embodiment according to the present invention, there is provided a gas turbine rotor assembly, comprising a rotatable shaft, a plurality of turbine rotors each including a disc mounted on the shaft and turbine buckets on the discs along their outer rims. A pair of cylindrical actuators has opposite ends thereof secured respectively to the shaft and adjoining ends free and overlapping concentrically one within the other radially inwardly of the discs, at least one of the actuators being responsive to a change in temperature to expand in one axial direction relative to the other of the actuators, the actuators having at least one opening each therethrough and in the overlapping portions, the openings at least partially registering one with the other. Means are provided for supplying compressor extraction air within the cylindrical actuators for communication through the registering openings, the one actuator being movable in one axial direction in response to a change in temperature during transient turbine operation to change the extent of registration of the openings relative to one another thereby to alter the flow of air from within the actuators through the registering openings to opposite sides of one of the rotor discs.

In a further preferred embodiment according to the present invention, there is provided a method of operating a gas turbine rotor assembly having a rotatable shaft, a plurality of turbine rotors mounted on the shaft, each including a disc with buckets along its outer rim, and a pair of cylindrical actuators defining an air channel and overlapping portions with openings therethrough for supplying air to the rotors, comprising the steps of (a) thermally expanding one of the actuators in one axial direction to register at least part of the openings through one actuator with the openings through the other actuator to enable flow of air from the channel to at least one rotor and (b) thermally expanding the other of the actuators in an axial direction to change the extent of registration of the openings one with the other and alter the flow of air from the channel through the registering openings to the rotor.

Accordingly, it is a primary object of the present invention to provide novel and improved apparatus and methods for uniformly heating during transient operation, including start-up, opposite sides of one or more discs of a turbine rotor and without cooling air losses during steady state operation.

These and further objects and advantages of the present invention will become more apparent upon reference to the following specification, appended claims and drawings.

BRIEF DESCRIPTION OF THE DRAWING FIGURES

DETAILED DESCRIPTION OF THE DRAWING FIGURES

Reference will now be made in detail to the present preferred embodiment of the invention, an example of which is illustrated in the accompanying drawings.

Figure 1:
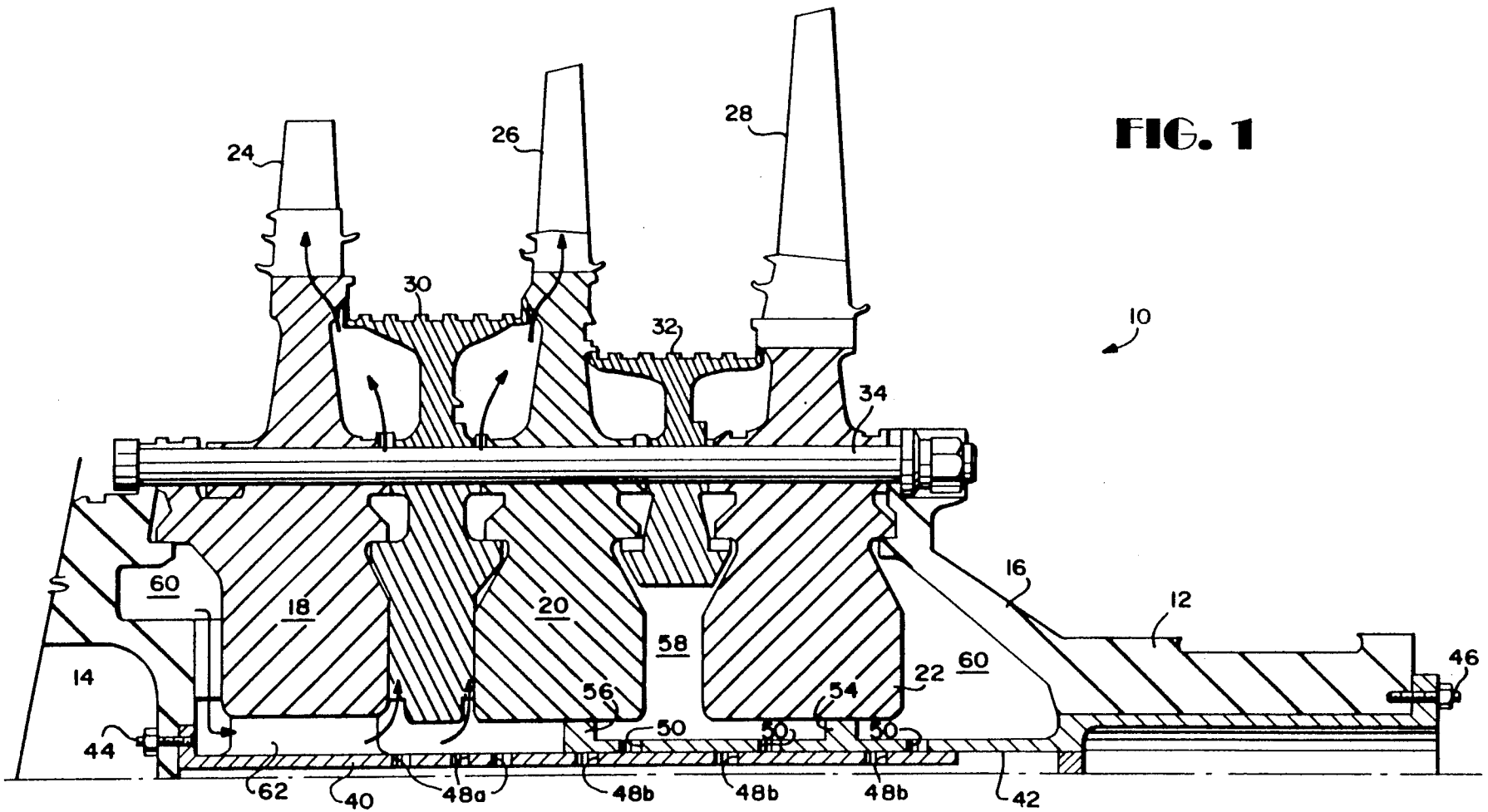
FIGS. 1 and 2 are fragmentary cross-sectional half views illustrating a longitudinal section through the axis of a gas turbine constructed in accordance with the present invention illustrating, in FIG. 1, the turbine in a start-up or cold condition and, in FIG. 2, the turbine during transient operation.
Figure 2:
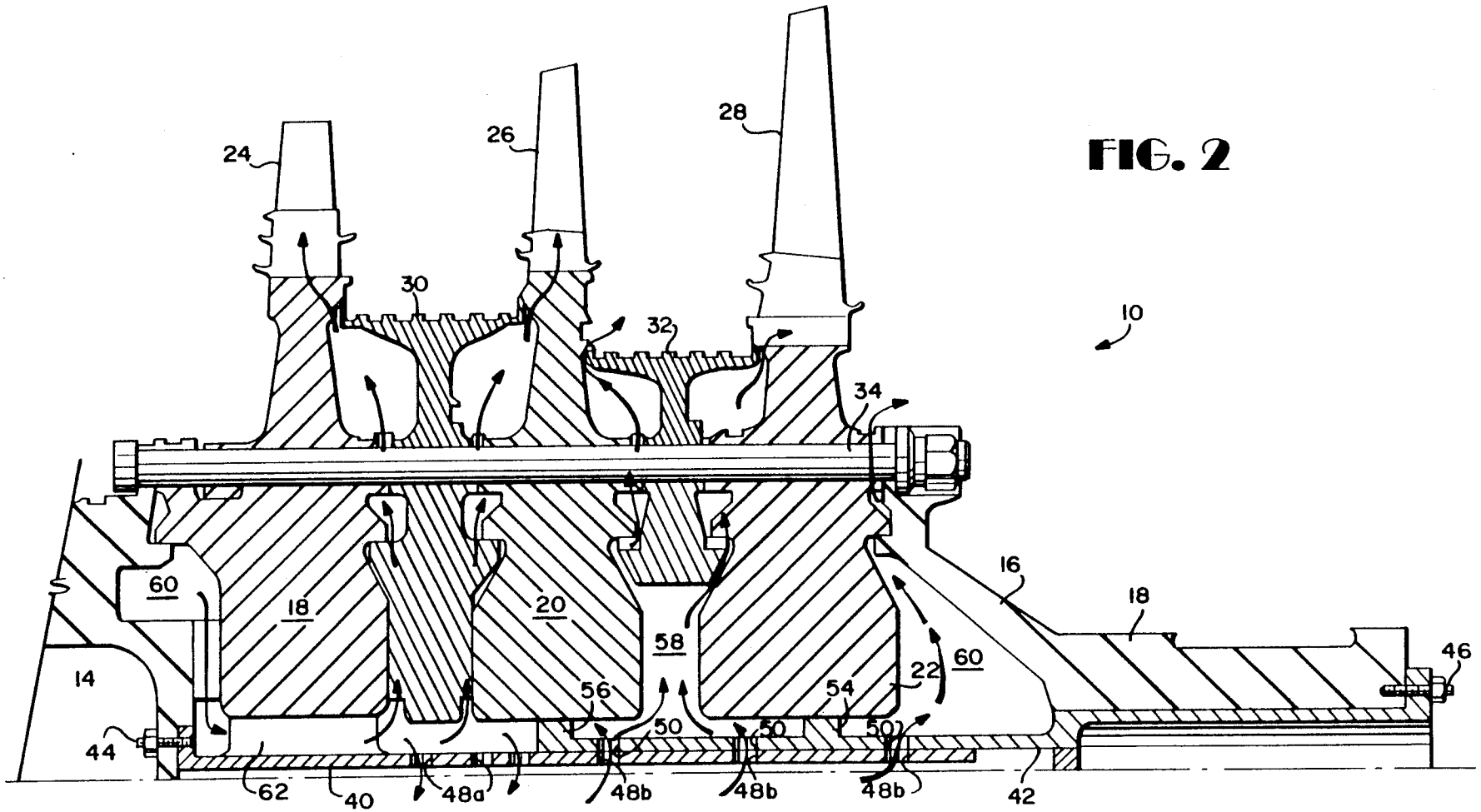

Referring now to the drawings, particularly to FIGS. 1 and 2, there is shown in cross-section a portion of the rotor structure of a gas turbine, generally designated 10. The gas turbine includes the usual compressor, combustors, outer casing and other ancillary structure, which will be apparent to those of skill in this art. As illustrated in FIG. 1, rotor structure 10 includes a shaft 12 having a forward flange 14 and an aft flange 16. On shaft 12, there is mounted a plurality of rotor discs, three being illustrated, and including a forward disc 18, an intermediate disc 20 and an aft disc 22. It will be appreciated that the present invention is useful with turbines having additional discs. Buckets 24, 26 and 28 are mounted about the outer periphery of rotors 18, 20 and 22, respectively. Spacers 30 and 32 are sealingly disposed between the forward and intermediate discs 18 and 20 and the intermediate and aft discs 20 and 22, respectively. Bolts, one being shown at 34, extend through the flanges 14 and 16 at the forward and aft ends of shaft 12 to secure the rotor discs and spacers in abutting relation one with the other. It will be appreciated that the foregoing-described rotor structure is conventional in the art and that there is substantial additional structure which is not disclosed herein but which those skilled in this art will understand as necessary to the operation of a gas turbine rotor.

In accordance with the present invention, there is provided first and second generally cylindrical actuators 40 and 42. Each actuator is secured at one end to an opposite end of shaft 12, i.e., to flanges 14 and 16, respectively, and extends toward the other of the actuators terminating in a free distal end. That is, first actuator 40 is secured at its forward end by suitable bolts 44 to flange 14 and extends in the aft direction. Second actuator 42 is bolted at the aft end of shaft 12 by bolts 46 and extends forwardly. Portions of the distal ends of the actuators 40 and 42 overlap and lie concentric with respect to one another, i.e., the distal end portion of actuator 40 overlaps and lies within the distal end portion of actuator 42. Each actuator 40 and 42 is provided with a plurality of openings 48 and 50, respectively, at circumferentially and axially spaced positions therealong. For example, actuator 40 includes openings **48*a* in the area of the actuator which is not initially overlapped with actuator 42, as well as openings 48*b* in the area of actuator 40 which is overlapped with actuator 42. Actuator 42 includes openings 50, lying in overlapping relation to the distal end portion of actuator 40**.

Actuator 42 has a pair of axially spaced collars 54 and 56 which project radially outwardly from its outer surface for sealing engagement with the inner peripheral surfaces of rotor discs 22 and 20, respectively. As illustrated, collar 54 separates chambers 58 and 60 one from the other on opposite sides of the aft rotor disc 22. The forwardmost collar 56 bears along the inner surface of the intermediate rotor disc 20.

From the foregoing description, it will be appreciated that each of the actuators 40 and 42 is supported only from one end and extends freely at its opposite end. The actuators may be formed of a high expansion material, such as stainless steel or nickel-type alloys. Thus, the actuators are constructed such that thermal expansion of the actuators in axial directions may be obtained in response to temperature changes. It will also be appreciated that relative movement of the actuators 40 and 42 in response to thermal expansion will cause openings **48*b* and 50 to move between wholly misaligned positions, partially overlapped registering positions and fully overlapped registering positions of maximum area. It will also be appreciated that hot compressor discharge gases (cooling air) supplied within the actuators through actuator openings 48*a*are contained therein when the openings of the actuators are misaligned or for flow radially outwardly through the openings when openings 48*b* and 50** are partially or wholly aligned and registered one with the other.

In operation, and referring to FIG. 1, the rotor assembly 10 is illustrated in a start-up condition, i.e., cold. Openings 50 and **48*b* of actuators 42 and 40, respectively, are misaligned, thereby preventing communication of air through such openings between the interior of the actuators and chambers 58 and 60. Upon start-up, cooling air is ducted through passages 60 and 62 into areas between the aft side of the forward disc 18 and the front side of spacer 30, as well as between the aft side of spacer 30 and forward side of disc 20. As the hot compressor extraction air flows over actuator 40, along its radially outer surface and radially inwardly through openings 48*a*, actuator 40 thermally expands in an axial rearward direction and causes movement of openings 48*b* to at least in part overlap openings 50 of actuator 42. The partially registering openings 48*b* and 50 thus enable compressor extraction air within the actuators supplied through openings 48*a* to flow through the partially registering openings 48*b* and 50 radially outwardly into chambers 58 and 60 on opposite sides of the aft rotor disc 22. The hot compressor extraction gas flowing through the partially registering openings also heats actuator 42. Actuator 42 thus thermally expands in an axially forward direction, i.e., an axial direction opposite to the direction of axial expansion of actuator 40, to move its openings 50 into further alignment and registration with the openings 48***b* of actuator 40. In this manner, the aggregate flow area through the registering openings is increased and greater quantities of compressor discharge air are supplied through openings 48*b* and 50 to the opposite sides of rotor disc 22. Consequently, the air entering chambers 58 and 60 uniformly heat the aft portions of each of rotors 22 and 20 and the forward portion of rotor 22.

As the temperature of the rotor structure increases toward its steady state operation, the rotor itself axially expands. This causes actuator 42 to be displaced away from or rearwardly relative to actuator 40, thus reducing the area of the aligned openings and enabling reduced flow through the registering openings. As the rotor continues to heat and approaches its steady state temperature, the effect of the rotor expansion causes misalignment of the openings 50 and 48*b* such that the flow of cooling air through the openings is completely shut down.

Figure 3A:
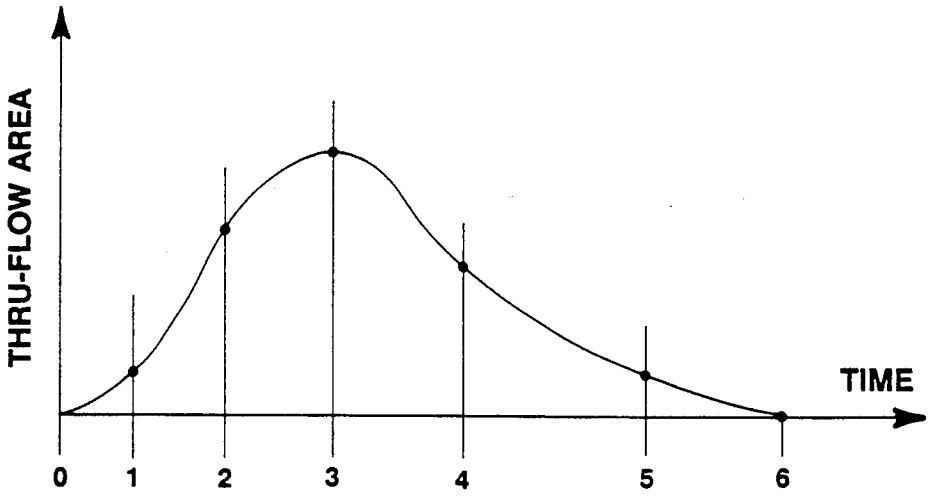
FIG. 3A is a graph illustrating a transient opening response curve constituting a plot of time on the abscissa versus through-flow area of the registering actuator openings on the ordinate.

This type of operation is graphically illustrated with reference to FIGS. 3A and 4. In FIG. 3A, there is illustrated a plot of time on the abscissa versus the through-flow area of the registering openings during start-up. Thus, at time zero, the openings 48*b* and 50 are wholly misaligned and there is no flow through them. Upon start-up, the thermal expansion of the actuators 40 and 42, as previously described, causes initial overlap and then increasing overlap to gradually increase the aggregate flow-through area of the aligned openings up to time 3. At time 3, the turbine rotor assembly is approaching steady state operation and thus is itself axially expanding in response to these thermal conditions. The thermal expansion of the rotor assembly axially displaces actuator 42 and hence openings 50 such that the aggregate flow through area of the aligned openings decreases. This is illustrated by the downside of the curve in FIG. 3 between time 3 and time 6. At time 6, the steady state operation has been reached and the thermal expansion of the rotor assembly causes the openings to be fully closed.

Figure 4:
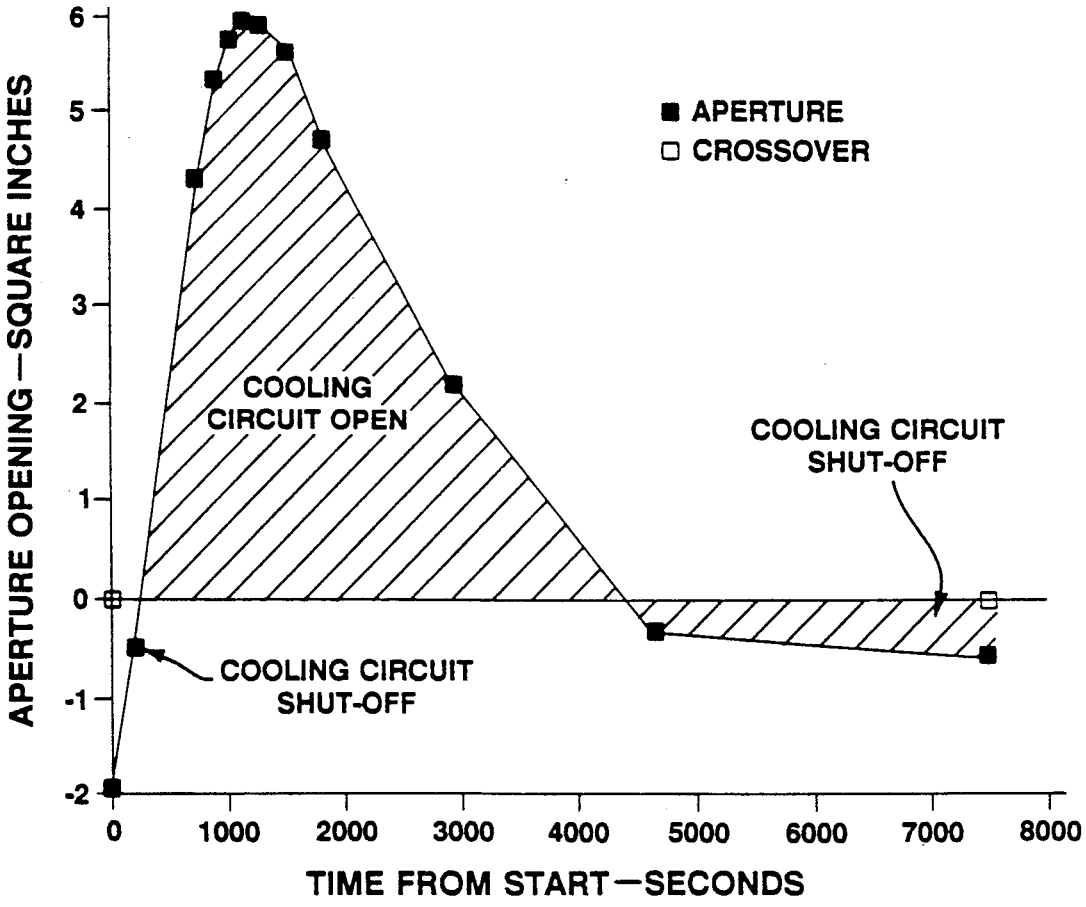
FIG. 4 is a plot illustrating the transient axial displacements of the rotor and actuator on the ordinate and time on the abscissa.

Looking at FIG. 4, there is illustrated an actual plot of time from start-up along the abscissa versus aggregate opening area along the ordinate. It will be appreciated that as start-up occurs, the thermal expansion of the actuators causes the aggregate flow area to increase, hence affording a uniformity of air to opposite sides of the rotor discs up to a predetermined time, in this instance, approximately 1600 seconds from start-up. At that time, the rotor assembly is approaching a steady state temperature and hence the thermal expansion of the rotor assembly itself causes increasing misalignment of the openings 50 and 48*b* to decrease the flow-through area of the registering openings. This is indicated by the downside of the curve in FIG. 4 until the curve reaches a cross-over point, where the openings are totally misaligned.

Figure 5:
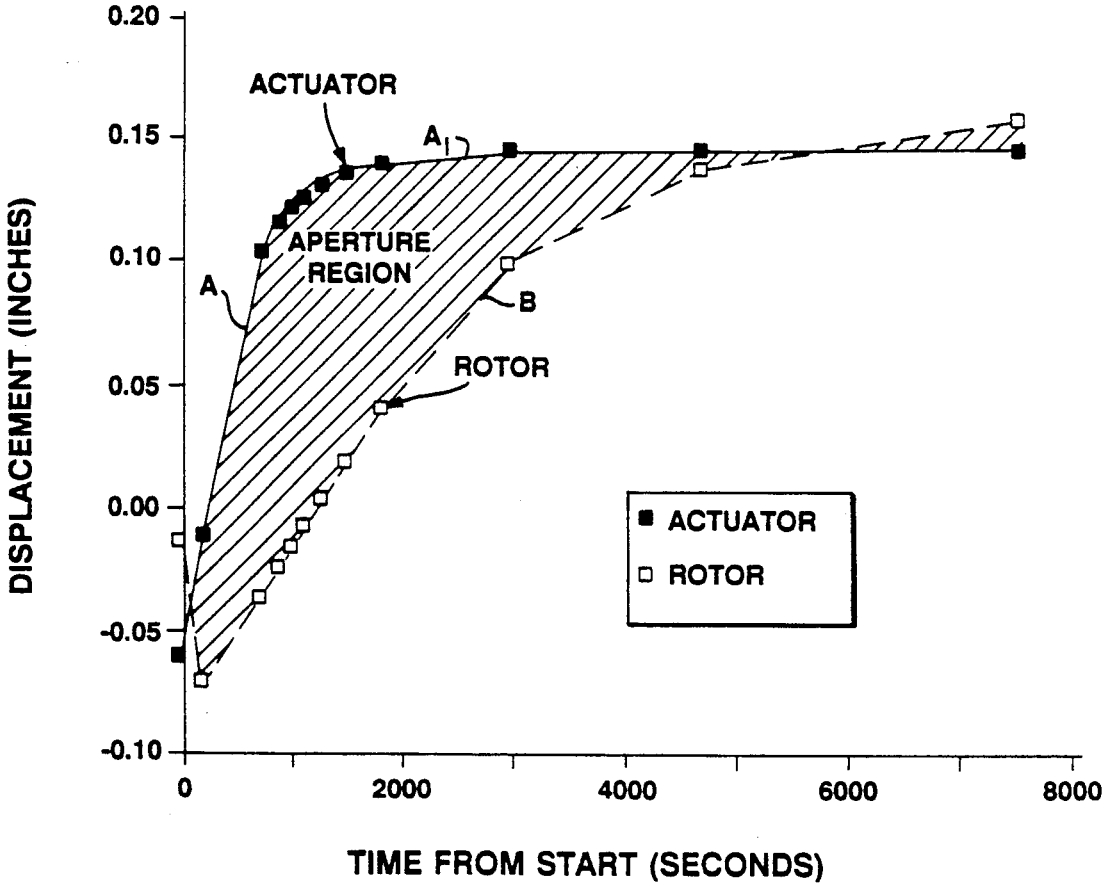
FIG. 5 is a graph illustrating transient axial displacements of both the rotor assembly and actuator versus time.

The combined axial displacements of the rotor assembly and actuators versus time are illustrated in FIG. 5. In that graph, it will be seen from curve A that the thermal displacement of the actuators proceeds at a faster pace than the displacement of the rotor assembly itself, as illustrated by curve B. However, the actuator displacement slows nearing steady state, as illustrated by the flattening portion A1 of curve A and the displacements are the same at steady state operation as illustrated by the crossing of curves A and B.

The actuators hereof and their arrangement within the gas turbine rotor may also be adapted to control bucket cooling flows during transient or steady state operation. That is, the thermal linear actuator hereof may be used in an inverse manner to the manner previously described to provide cooling air to the turbine buckets during steady state operation, compressor extraction air to the buckets during start-up and adjusted compressor extraction air during transient time, e.g., to reduce low-cycle fatigue problems. Thus, the actuators may be initially formed such that the openings in the overlap portions are initially aligned one with the other. Additionally, passages may be provided in the rotors or between the rotors and spacers to the turbine buckets to supply heated (cooling) air to the buckets during start-up. With the openings thus initially aligned, compressor extraction air may flow through the openings and the passages to the buckets to preheat the buckets if needed. When the buckets are preheated sufficiently, the actuators, through their thermal expansion characteristics, are displaced relative to one another to misalign the openings, thus reducing compressor extraction air from flowing in and about the turbine buckets. As the turbine buckets heat and obtain steady state operation, it may be desirable to over-cool the buckets through the same passages. Thus, the further thermal expansion of the rotor assembly would cause the openings to register one with the other once again and enable compressor extraction air to flow to the buckets.

Figure 3B:
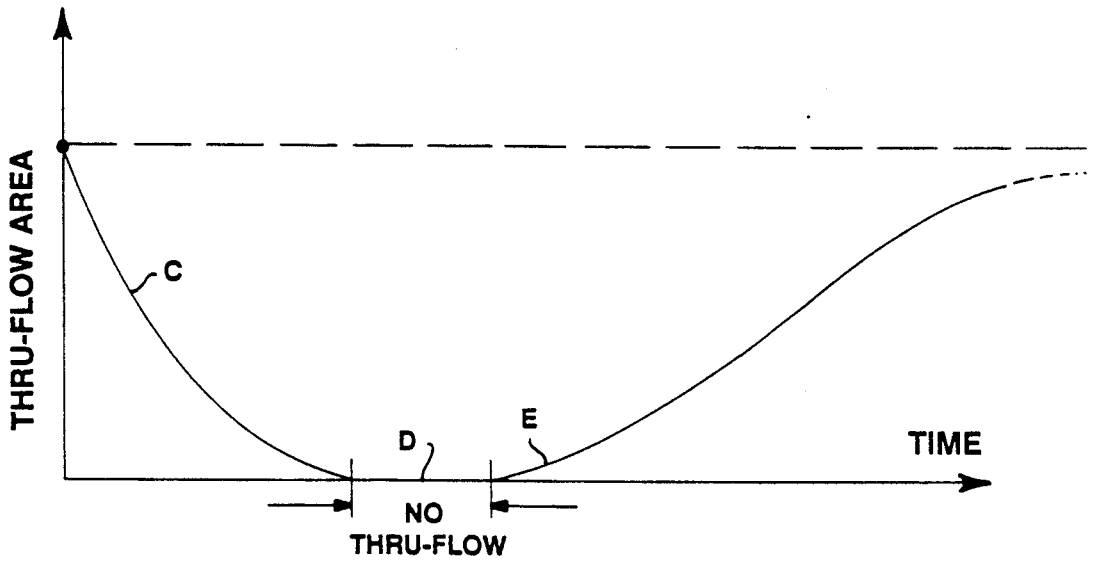
FIG. 3B is a view similar to FIG. 3A illustrating a further embodiment for a different application of the present invention, that is, making air flow available to cool buckets at steady state but restricting it during transient operation, to reduce thermal stresses, and increase low cycle fatigue life.

This is graphically illustrated in FIG. 3B. Thus, at start-up, the flow-through area is the largest and supplies air initially to heat the buckets. As the buckets heat up, the openings close through thermal expansion of the actuators. This is depicted by curve C in FIG. 3B. When the turbine buckets are sufficiently preheated, the thermal expansion of the actuators closes the openings to choke the flow through the openings, thus reducing the temperature difference between the bucket outer skin temperature and internal bucket cooling passages. This area of operation is illustrated in the limit by the zero flow-through area at D in FIG. 3B between curves C and E. As steady state operation is reached, the thermal expansion causes the openings to once again register one with the other and cooling air is provided to the turbine buckets at the higher firing temperatures. This is represented by the curve E, which illustrates that the steady state operation has the openings in full alignment one with the other. Thus, heating and cooling flows to the buckets may be controlled during transient operations.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A gas turbine rotor assembly, comprising:

a rotatable shaft;

a plurality of turbine rotors each including a disc mounted on said shaft;

turbine buckets on said discs along their outer rims;

a pair of cylindrical actuators having opposite ends thereof secured respectively to said shaft and adjoining ends free and overlapping concentrically one within the other radially inwardly of said discs, at least one of said actuators being responsive to a change in temperature to expand in one axial direction relative to the other of said actuators, said actuators having at least one opening each therethrough and in said overlapping portions; and means for supplying compressor extraction air within the cylindrical actuators for communication through said openings, said one actuator being movable in said one axial direction in response to a change in temperature during transient turbine operation to register at least in part its opening with the opening of said other actuator to enable air to flow from within said actuators through the registered openings to opposite sides of at least one of said rotor discs.

2. An assembly according to claim 1 wherein said other actuator is movable in an opposite axial direction in response to a change in temperature during transient operation to displace its opening to increase the area of registration of and the flow of air through the registering openings.

3. An assembly according to claim 1, wherein, at turbine rotor start-up, the openings in the overlapping actuator portions lie out of registration to preclude communication through the overlapped portions of the actuators.

4. An assembly according to claim 3 wherein said other actuator is movable in an opposite axial direction in response to a change in temperature during transient operation to displace its opening to increase the area of registration of and the flow of air through the registering openings.

5. An assembly according to claim 1 including means responsive to temperature changes during transient operation for displacing said actuators relative to one another to decrease the area of registration of and the aggregate flow of cooling air through the registering openings.

6. An assembly according to claim 5 wherein said other actuator is movable in an opposite axial direction in response to a change in temperature during transient operation to displace its openings to increase the area of registration of and the aggregate flow of air through the registering openings.

7. An assembly according to claim 6, wherein, at turbine rotor start-up, the openings in the overlapping actuator portions lie out of registration to preclude communication through the overlapped portions of the actuators.

8. An assembly according to claim 1 including a seal carried by said other actuator and sealing against the inner surface of said one disc, at least a pair of axially spaced openings carried by each said actuator.

9. An assembly according to claim 8 wherein said openings through said other actuator lie on opposite sides of said seal to enable air to flow along opposite sides of said one disc.

10. A gas turbine rotor assembly, comprising:

a rotatable shaft;

a plurality of turbine rotors each including a disc mounted on said shaft;

turbine buckets on said discs along their outer rims;

a pair of cylindrical actuators having opposite ends thereof secured respectively to said shaft and adjoining ends free and overlapping concentrically one within the other radially inwardly of said discs, at least one of said actuators being responsive to a change in temperature to expand in one axial direction relative to the other of said actuators;

said actuators having at least one opening each therethrough and in said overlapping portions, said openings at least partially registering one with the other;

means for supplying compressor extraction air within the cylindrical actuators for communication through said registering openings, said one actuator being movable in said one axial direction in response to a change in temperature during transient turbine operation to change the extent of registration of said openings relative to one another thereby to alter the flow of air from within said actuators through the registering openings to opposite sides of one of said rotor discs.

11. An assembly according to claim 10 wherein said other actuator is movable in an opposite axial direction in response to a change in temperature during transient operation to displace its opening to increase the area of registration of and the flow of air through the registering openings.

12. An assembly according to claim 10 including means responsive to temperature changes during transient operation for displacing said actuators relative to one another to decrease the area of registration of and the flow of cooling air through the registering openings.

13. A method of operating a gas turbine rotor assembly having a rotatable shaft, a plurality of turbine rotors mounted on said shaft, each including a disc with buckets along its outer rim, and a pair of cylindrical actuators defining an air channel and overlapping portions with openings therethrough for supplying air to said rotors, comprising the steps of:

(a) thermally expanding one of said actuators in one axial direction to register at least part of the openings through said one actuator with the openings through the other actuator to enable flow of air from said channel to at least one rotor; and (b) thermally expanding the other of said actuators in an axial direction to change the extent of registration of said openings and alter the flow of air from said channel through said registering openings to said rotor.

14. A method according to claim 13 including displacing said other actuator relative to said one actuator in said one direction to alter the flow of air through said registering openings in said actuators.

15. A method according to claim 13 including displacing said other actuator to misalign the openings thereof relative to the openings in the one actuator thereby to prevent flow of air from said channel through said openings.

16. A method according to claim 13 including thermally expanding the other of said actuators in an axial direction opposite to the axial direction of thermal expansion of said one actuator to increase the extent of registration of said openings and increase the flow of air from said channel through said registering openings.

17. A method according to claim 16 including displacing said other actuator relative to said one actuator in said one direction to decrease the flow of air through said registering openings in said actuators.

18. A method according to claim 16 wherein said gas turbine has start-up and steady state operations, prior to turbine start-up operation, said actuator openings are misaligned, and including performing step (a) after start-up operation and before steady state operation.

19. A method according to claim 18 including performing step (b) before steady state operation occurs.

20. A method according to claim 19 including displacing said other actuator, prior to steady state operation, to misalign the openings thereof relative to the openings in the one actuator thereby to choke the flow, wholly or in part, from said channel through said openings.

21. A method according to claim 20 wherein the openings are misaligned and flow through the openings is choked off during steady state operation.

* * * * *